US005310425A

United States Patent [19]

Nakagawa et al.

[11] Patent Number: 5,310,425

[45] Date of Patent: May 10, 1994

[54] TONER CONCENTRATION DETECTOR FOR A TWO-COMPONENT DEVELOPER

[75] Inventors: Shiro Nakagawa, Chiba; Taisuke Domon, Ichikawa; Takehiro Imai, Ichikawa; Eiji Takahishi, Ichikawa, all of Japan

[73] Assignee: TDK Corporation, Tokyo, Japan

[21] Appl. No.: 15,165

[22] Filed: Feb. 9, 1993

Related U.S. Application Data

[63] Continuation-in-part of Ser. No. 601,526, Oct. 23, 1990, abandoned, which is a continuation-in-part of Ser. No. 465,632, Jan. 9, 1990, abandoned, which is a continuation of Ser. No. 187,431, Apr. 28, 1988, abandoned.

[30] Foreign Application Priority Data

May 19, 1987 [JP] Japan ..... 62-074868

[51] Int. Cl.[5] ..... B05C 11/00; G03G 21/00

[52] U.S. Cl. ..... 118/689; 355/246

[58] Field of Search ..... 355/205, 208, 246, 207; 118/688, 689, 690; 323/354, 370

[56] References Cited

U.S. PATENT DOCUMENTS

| | | | |
|---|---|---|---|
| 3,519,930 | 7/1970 | Bradley | 323/354 X |
| 4,240,375 | 12/1980 | Terashima | 118/689 |
| 4,270,487 | 6/1981 | Terashima et al. | 118/690 |
| 4,592,645 | 6/1986 | Kanai et al. | 355/246 X |
| 4,721,985 | 1/1988 | Pavlidis et al. | 333/205 X |
| 4,845,467 | 7/1989 | Nagaoka | 371/12 X |

FOREIGN PATENT DOCUMENTS

| | | |
|---|---|---|
| 60-154275 | 8/1985 | Japan . |
| 60-254170 | 12/1985 | Japan . |
| 61-149858 | 7/1986 | Japan . |

*Primary Examiner*—R. L. Moses
*Assistant Examiner*—Robert Beatty
*Attorney, Agent, or Firm*—Keck, Mahin & Cate

[57] ABSTRACT

A toner concentration detecting device for detecting a toner concentration of a two component developer including a differential transformer which is connected with a phase detecting circuit. A variable capacitance diode is connected between the primary coil and the secondary coil and a variable resistor is provided to supply the variable capacitance diode with a DC voltage to vary the capacitance of the diode. The variable resistor and DC voltage are located at a remote location from the transformer.

5 Claims, 5 Drawing Sheets

TONER CONCENTRATION DETECTOR FOR A TWO-COMPONENT DEVELOPER

CROSS REFERENCE TO RELATED APPLICATIONS

This application is a continuation-in-part of application Ser. No. 07/601,506, filed Oct. 23, 1990, now abandoned which is a continuation-in-part of application No. 07/465,632 filed Jan. 9, 1990, which is itself a continuation of application Ser. No. 07/187,431 filed Apr. 28, 1988 and now abandoned.

BACKGROUND OF THE INVENTION

1. Field of the Invention

The present invention relates to means for detecting toner concentration in a two component type developer for an electrostatic copying machine or other apparatus which is designed to produce copies in accordance with the principle of the electrostatic photography. More particularly, the present invention pertains to toner concentration detecting means of a type which contains a differential transformer.

2. Description of the Prior Art

A so-called two component type developer for developing a latent image includes a carrier in the form of particles of a magnetic material and powders of a colored toner. In order to maintain the quality of the copies to be produced, it is required to maintain the concentration of the toner in the developer within a desired range. The U.S. Pat. No. 4,592,645 issued to K. Kanai et. al. on Jun. 3, 1986 proposes a toner concentration controlling apparatus which utilizes a differential transformer. According to the proposal by the U.S. patent, the differential transformer has a primary winding and a pair of secondary windings which are wound in opposite polarities around a core. The primary winding and one of the secondary windings provide a detection transformer which is adapted to be placed adjacent to the developer in the developer container and produces a detection signal representing the toner concentration in the developer. The primary winding and the other of the secondary windings provide a reference transformer which is adapted to provide a reference signal. The detection and reference transformers have outputs which are connected with a phase detection circuit which is adapted to detect the difference in the phase of the outputs of the detection and reference transformers. A similar toner concentration detection device is also disclosed by the Japanese laid-open patent application 60-154275 disclosed for public inspection on Aug. 13, 1985.

In using the toner concentration detecting device of this type, it is required to make a toner concentration adjustment after it has been mounted on the developer container so that any manufacturing tolerances are compensated for. Although not specifically illustrated in the aforementioned U.S. patent, described therein is an adjusting screw provided in the magnetic gap of the reference transformer for adjusting the coupling coefficient of the reference transformer.

A conventional type arrangement for the adjustment of the coupling coefficient of the reference transformer provides a variable capacitor between the primary and secondary windings.

However, the conventional arrangement has inconveniences in determining the type of variable capacitor to be used. A ceramic variable capacitor is preferable in that it is compact and has a high heat resistant property. However, it has an inherent disadvantage of a setting drift wherein the capacitance of the capacitor changes after a certain time period due to a change in the thickness of the silicon oil film which is provided between the rotor and the stator of the capacitor. Therefore, it is difficult to carry out an accurate adjustment with the use of the ceramic variable capacitor. Other types of capacitors are not preferable because they are generally bulky and do not have satisfactory heat resistance.

A further problem in using a variable capacitor is that when it is desired to locate the variable capacitor in a readily accessible position it is required to provide an extension of a high frequency wiring. Such a high frequency wiring can cause noises which may lead to an unreliable operation of the detecting device. Therefore, it is difficult to locate the variable capacitor in a readily accessible place.

SUMMARY OF THE INVENTION

It is therefore an object of the present invention to provide toner concentration detecting means using a differential transformer in which an adjustment of the coupling coefficient can be readily made without any adverse effect.

Another object of the present invention is to provide toner concentration detecting means having differential transformer with compact and reliable means for adjusting the coupling coefficient.

A further object of the present invention is to provide toner concentration detecting means having differential transformer with means for adjusting the coupling coefficient which is of a high heat resistance.

Still further object of the present invention is to provide toner concentration detecting means with means for adjusting the coupling coefficient of the differential transformer which is located at a readily accessible place without any problem of high frequency noise.

According to the present invention, the above and other objects can be accomplished in a toner concentration detector including differential transformer means having primary and secondary coils for producing a differential output from the secondary coil in response to an oscillating frequency signal applied to the primary coil and capacitive circuit means for adjusting the coupling coefficient between the primary and secondary coils to control the concentration of toner in a developer, by extension wiring means interconnecting the primary and secondary coils with the capacitive circuit means at an accessible location thereof remote from the transformer means and means associated with the capacitive circuit means for reducing high frequency noise resulting from current conducted through the extension wiring means including a variable capacitive diode capacitively coupled between the primary and secondary coils, separate adjustable means for applying a voltage for varying the capacitive diode to control the coupling coefficient between the primary and secondary coils. The voltage applying means may be means for applying a DC voltage to the diode means. According to a preferable feature of the present invention, capacitor means may be connected between the primary coil means and the secondary coil means in series with the diode means.

According to the features of the present invention, the capacitance of the diode means is controlled through an adjustment of the voltage applied to the diode so that the coupling coefficient is adjusted. There is no possibility of the phase of the voltage applied from the primary coil means to the secondary coil means being changed due to the adjustment because the voltage is changed through the adjustment of the capacitance of the diode. Further, no problem will be produced such as the setting drift as experienced in the case of using a ceramic variable capacitor. It is therefore possible to carry out a precise and accurate adjustment. It should further be noted that the means for applying the voltage to the diode can be constituted as a DC circuit so that it can be made separate from the high frequency circuit having the variable capacitance diode. Therefore, it is possible to locate the voltage adjusting means at any place which is readily accessible.

The above and other objects and features of the present invention will become apparent from the following descriptions of preferred embodiments taking reference to the accompanying drawings.

DETAILED DESCRIPTION OF THE PREFERRED EMBODIMENTS

Figure 4:
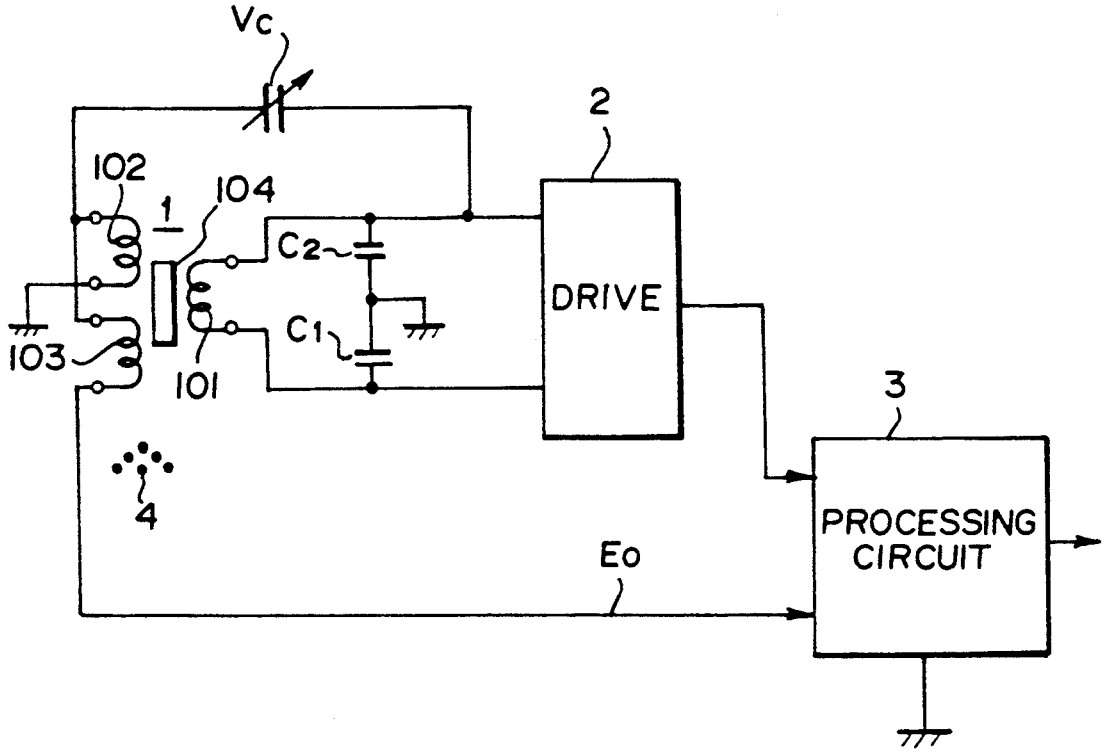
FIG. 4 (PRIOR ART)
FIG. 4 is a circuit diagram showing an example of prior art.

Referring initially to FIG. 4, a conventional toner concentration detecting device is shown, including a differential transformer having a primary winding 101, a reference secondary winding 102 and a detection secondary winding 103. The primary winding 101 has opposite ends which are connected with capacitors $C_1$ and $C_2$. The primary winding 101 is connected With a driving section 2 which forms an oscillating circuit together with the primary winding 101 and the capacitors $C_1$ and $C_2$. The reference secondary winding 102 has one end which is grounded. The other end of the reference secondary winding 102 is connected with one end of the detecting secondary winding 103. The other end of the detecting secondary winding 103 is connected with a processing section 3 which may be a phase detection circuit of a conventional type. The driving circuit 2 is also connected with the processing circuit 3 to provide the processing circuit 3 with a reference signal. The secondary windings 102 and 103 of opposite polarity are wound around a core 104 so that a differential output $E_0$ is produced in the detection secondary winding 103. The processing circuit 3 functions to compare the phase of the differential output $E_0$ with the phase of the reference signal supplied from the driving circuit 2 to produce an output signal corresponding to the phase difference.

As shown in FIG. 4, the ends of the secondary windings 102 and 103 which are connected together are also connected with one end of the primary winding 101 through a variable capacitor $V_c$ so that the secondary windings 102 and 103 have a voltage applied thereto which is determined by the capacitance of the capacitor $V_c$. Through an adjustment of the capacitance of the variable capacitor $V_c$ in accordance with toner concentration, corresponding adjustment of the output signal (or graphical working distance) is made possible.

Figure 1:
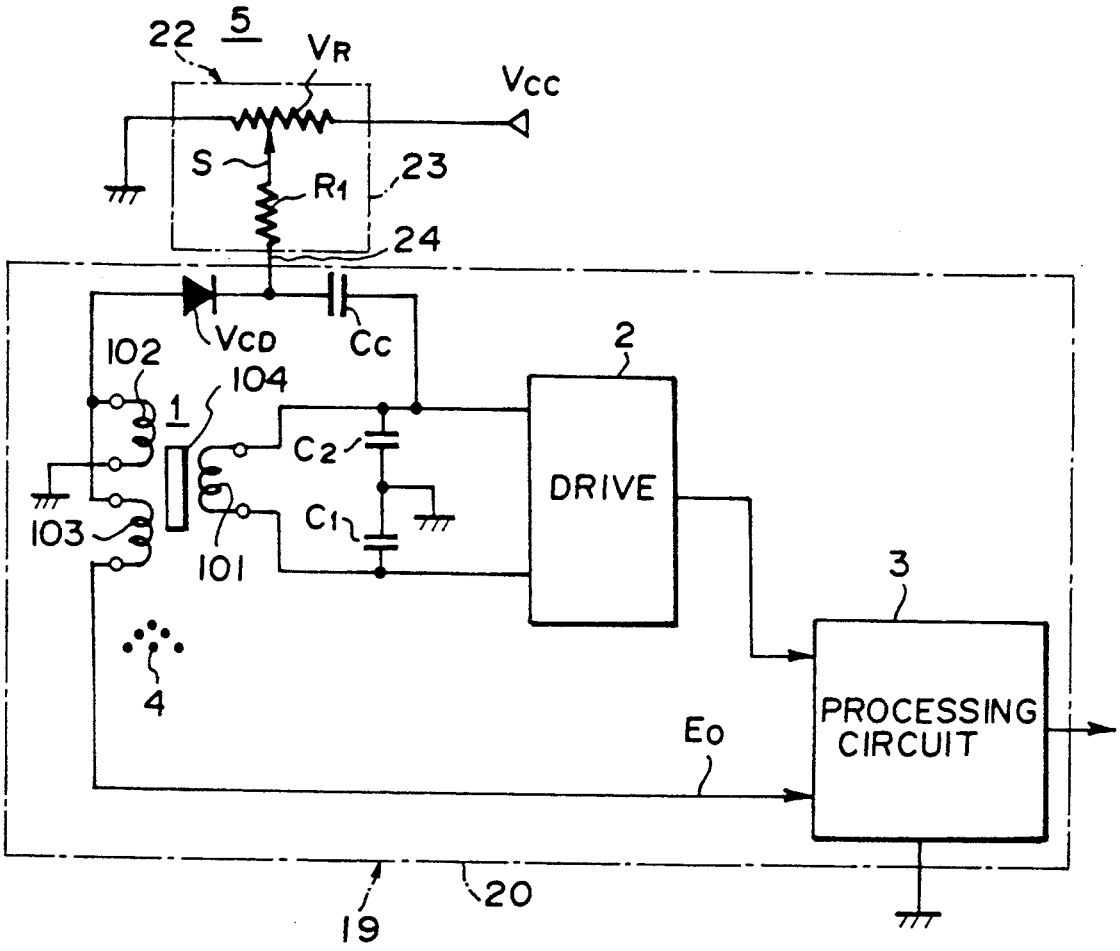
FIG. 1 is a schematic circuit diagram showing a toner concentration detecting device in accordance with one embodiment of the present invention.

Referring now to FIG. 1, there is shown a toner concentration detecting device which includes a differential transformer 1 having a primary coil 101, a reference secondary coil 102 and a detecting secondary coil 103. As in the conventional system shown in FIG. 4, capacitors $C_1$ and $C_2$ are connected between the opposite ends of the primary coil 101. Further, a driving circuit 2 and a phase detecting circuit 3 are provided and connected with the differential transformer 1 as in the conventional system shown in FIG. 4. The phase detecting circuit 3 is located adjacent to a developer 4 containing a toner. The developer 4 is contained in a developer container as shown in FIG. 1*a* or 1*b* of the U.S. Pat. No. 4,592,645. The toner concentration detecting device comprising the differential transformer 1, the driving circuit 2 and the phase detecting circuit 3 may also be positioned as shown in the above U.S. patent. In FIG. 1, it will be noted that a variable capacitance diode $V_{CD}$ and a capacitor $C_c$ are connected in series between the primary coil 101 and the secondary coil 102 of the differential transformer There is provided a variable voltage applying circuit 5 which includes a variable resistor $V_R$ connected at one end with a DC voltage source $V_{CC}$. The other end of the variable resistor $V_R$ is grounded. A slider S of the variable resistor $V_R$ is connected through a resistor $R_1$ between the diode $V_{CD}$ and the capacitor $C_C$.

The DC voltage is thus applied through the variable resistor $V_R$ and the resistor $R_1$ to determine the capacitance of the variable capacitance diode $V_{CD}$. It is therefore possible to determine the voltage applied from the primary coil 101 to the secondary coil 102.

Figure 2:
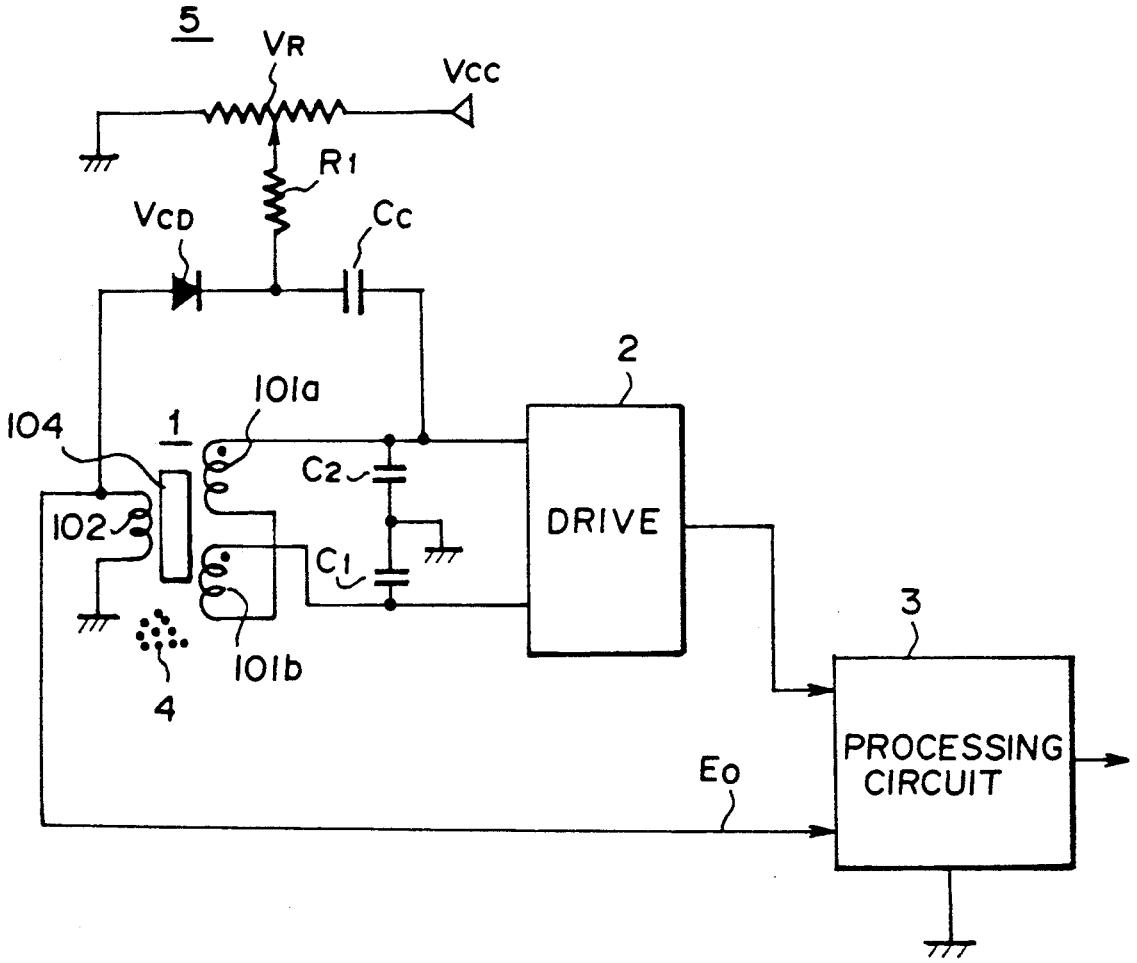
FIG. 2 is a circuit diagram similar to FIG. 1 but showing another embodiment.

Referring to FIG. 2, there is shown another embodiment of the present invention in which the differential transformer 1' comprises a pair of primary coils 101*a* and 101*b* which are connected in opposite polarity. The transformer 1' further includes a secondary coil 102' which is connected with the phase detecting circuit 3. Between one end of each of the primary coils 101*a* and 101*b*, there are connected capacitors $C_1$ and $C_2$. In other respects, the arrangements are the same as those in the previous embodiment. Therefore, further descriptions will be omitted in view of corresponding parts being labeled by the same reference numerals as in FIG. 1.

Figure 3:
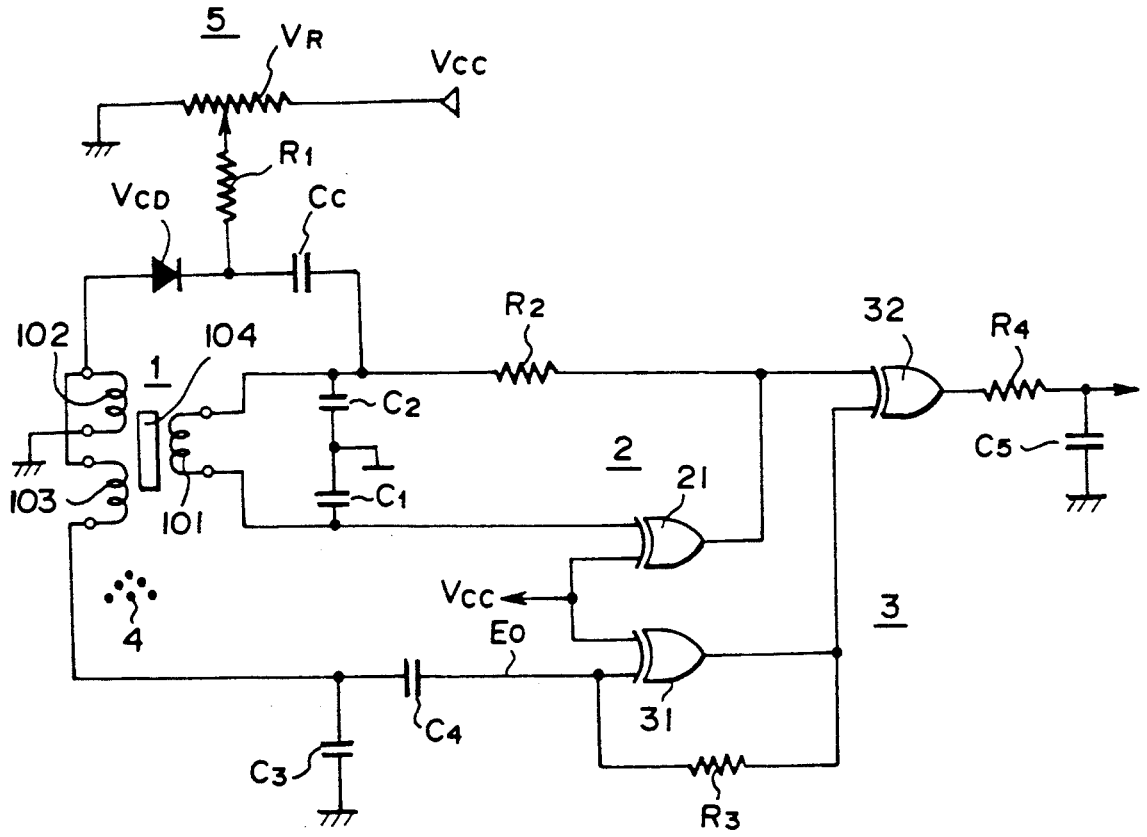
FIG. 3 is a circuit diagram showing the details of the circuit shown in FIG. 1.

Referring to FIG. 3, there are shown details of the circuits 2 and 3 shown in FIG. 1. The driving circuit 2 is in the form of an oscillating circuit constituted by the aforementioned capacitors $C_1$ and $C_2$, an exclusive OR gate circuit 21 and a resistor $R_2$. The output of the oscillating circuit is connected with the primary coil 101 of the differential transformer 1 to drive the transformer 1. Further, the oscillating circuit has an output connected with a phase detecting circuit 32 which constitute a part of the processing circuit 3. The phase detecting processing circuit 3 may be constituted by an exclusive OR gate 32 and an amplifier formed by an OR gate 31 provided with a negative feedback resistor $R_3$ and connected through a capacitor $C_4$ with the detecting coil 103 of the differential transformer 1. A capacitor $C_3$ is further connected between the detecting coil 103 and the capacitor $C_4$. The phase detecting gate 32 has an output resistor $R_4$ and a smoothing capacitor $C_5$. The phase of the output of the differential transformer is a function of the toner concentration in the developer so that the toner concentration can be detected by detecting the change in the phase of the output of the differential transformer 1 through the phase detecting gate 32 of circuit 3.

Figure 5:
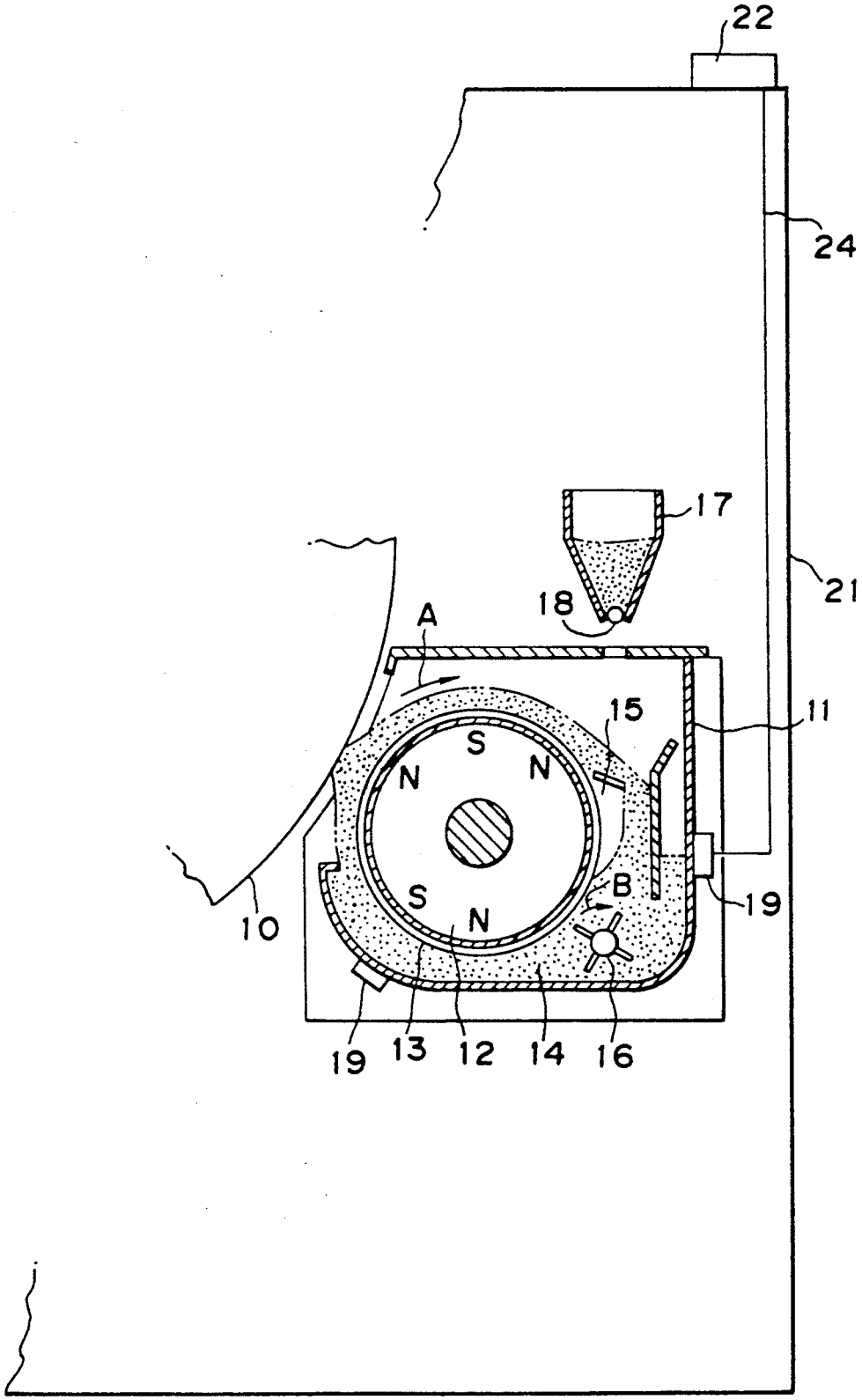
FIG. 5 is a schematic showing an example of a developing device having a toner detector.

Referring to FIG. 5, there is shown an example of a developing device having a toner detector in accordance with the present invention. The developer is designed for a photosensitive drum 10 and includes a housing 11 in which a magnet roll 12 is rotatably supported. The magnet roll 12 is covered by a sleeve 13 of a non magnetic material and rotationally driven in the direction shown by an arrow A.

In the housing 11, there is charged developer 14 which is attracted to the surface of the sleeve 13 as the magnet roll 12 rotates. Adjacent to the magnet roll 12, there is provided a scraper blade which functions to scrape off the developer from the surface of the sleeve 13. In the housing 11, there is further provided a stirrer 16 which is rotationally driven in the direction shown by an arrow B.

In order to replenish toner, there is provided a toner hopper 17 provided at the bottom with a toner replenishing valve 18. Toner concentration sensors 19 are mounted on the housing 11 at an outer surface of the housing 11. Each sensor 19 may be formed by the part encircled by a broken line 20 in FIG. 1. The developing device is located in a outer housing 21 and an adjusting device 22 is located on the top surface of the outer housing 21. The adjusting device 22 may be formed by the variable resistor $V_R$ and the resistor $R_1$ which are shown in FIG. 1 and encircled by a broken line 23 in FIG. 1. An extension wire 24 connects the adjusting device 22 to the sensor 19. It will therefore be understood that the adjusting device 22 can be located in a position which is convenient to access. The extension wire 24 functions to apply DC voltage to the sensor 19 so that there will be no problem of noise being produced as may be produced through a use of high frequency wire.

The invention has thus been shown and described with reference to the specific embodiments, however, it should be noted that the invention is in no way limited to the details of the illustrated arrangements but changes and modifications may be made without departing from the scope of the appended claims.

We claim:

1. In a toner concentration detector including a differential transformer means having primary and secondary coils having a coupling coefficient therebetween for producing a differential output from the secondary coil and capacitive circuit means for adjusting the coupling coefficient between said primary and secondary coils, the improvement residing in said capacitive circuit means including means for reducing high frequency noise resulting from current conducted through extension wiring means and a variable capacitive diode capacitively coupled between said primary and secondary coils, and separate adjustable means for applying a voltage for varying the capacitance of said variable capacitive diode to control the coupling coefficient between said primary and secondary coil, the extension wiring means interconnecting the primary and secondary coils with the separate adjustable means to be located at an accessible location remote from the transformer means.

2. The toner concentration detector in accordance with claim 1 including a source of DC voltage connected to the variable capacitive diode through the adjustable means.

3. The toner concentration detector in accordance with claim 1 wherein the means for reducing high frequency noise includes a capacitor means connected between the primary and secondary coils in series with the diode means.

4. The toner concentration detector in accordance with claim 2 in which said adjustable means includes a variable resistor.

5. The toner concentration detector in accordance with claim 1 including phase detecting means connected to the secondary coil for determining the toner concentration.

* * * * *